US006426025B1

(12) United States Patent
Goeman

(10) Patent No.: US 6,426,025 B1
(45) Date of Patent: Jul. 30, 2002

(54) PROCESS FOR EXTRUDING FIBERS

(75) Inventor: Bart Goeman, Temse (BE)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/554,528

(22) PCT Filed: Feb. 12, 1997

(86) PCT No.: PCT/US98/25517

§ 371 (c)(1),
(2), (4) Date: May 12, 2000

(87) PCT Pub. No.: WO99/29936

PCT Pub. Date: Jun. 17, 1999

(30) Foreign Application Priority Data

May 12, 1997 (EP) ..... 97203812

(51) Int. Cl.[7] ..... D01F 1/10; D01F 6/04; D01F 6/06; D06M 15/256; D06M 15/277

(52) U.S. Cl. ..... 264/103; 264/130; 264/211; 264/211.14

(58) Field of Search ..... 264/103, 129, 264/130, 211, 211.14

(56) References Cited

U.S. PATENT DOCUMENTS

| | | | | |
|---|---|---|---|---|
| 2,723,999 | A | | 11/1955 | Cowen et al. |
| 2,915,554 | A | | 12/1959 | Ahlbrecht et al. |
| 3,341,497 | A | | 9/1967 | Sherman et al. |
| 3,420,697 | A | | 1/1969 | Sweeney et al. |
| 3,445,491 | A | | 5/1969 | Pacini |
| 3,470,124 | A | | 9/1969 | Eygen et al. |
| 3,544,537 | A | | 12/1970 | Brace |
| 3,546,187 | A | | 12/1970 | Tandy, Jr. |
| 3,787,351 | A | | 1/1974 | Olson |
| 3,839,312 | A | | 10/1974 | Oxenrider et al. |
| 4,043,964 | A | | 8/1977 | Sherman et al. |
| 4,054,592 | A | | 10/1977 | Dear et al. |
| 4,107,055 | A | | 8/1978 | Sukornick et al. |
| 4,190,545 | A | | 2/1980 | Marshall et al. |
| 4,192,754 | A | | 3/1980 | Marshall et al. |
| 4,264,484 | A | | 4/1981 | Patel |
| 4,477,498 | A | | 10/1984 | Deiner et al. |
| 5,025,052 | A | | 6/1991 | Crater |
| 5,370,919 | A | | 12/1994 | Fieuws et al. |
| 5,804,625 | A | | 9/1998 | Temperante et al. |
| 6,068,805 | A | * | 5/2000 | Lockridge et al. ..... 264/130 |

FOREIGN PATENT DOCUMENTS

| | | |
|---|---|---|
| EP | 0 516 271 A1 | 12/1992 |
| WO | WO 92/18569 A1 | 10/1992 |
| WO | WO 95/01396 A1 | 1/1995 |
| WO | WO 97/33019 A1 | 9/1997 |
| WO | WO 97/44508 A1 | 11/1997 |

OTHER PUBLICATIONS

Kirk–Othmer, Encyclopedia of Chemical Technology, 3rd Ed., vol. 24, pp. 448–451 (Undated).

* cited by examiner

*Primary Examiner*—Leo B. Tentoni
(74) *Attorney, Agent, or Firm*—Gilbert Voortmans; Lucy C. Weiss

(57) ABSTRACT

The present invention provides a process for obtaining a fiber comprising the steps of (a) melt extruding a mixture of a thermoplastic polymer and hydrophilicity imparting compound to form a plurality of filaments; (b) applying a spin finish to said filaments; and (c) spinning said filaments into a fiber; wherein said spin finish comprises fluorochemical. The invention also provides fibers, textiles and carpet prepared in accordance with the invention.

10 Claims, No Drawings

PROCESS FOR EXTRUDING FIBERS

FIELD OF THE INVENTION

The present invention relates to fiber production and fiber treatment that renders fiber soil resistant, oil repellent, and/or water repellent.

BACKGROUND OF THE INVENTION

In the formation of textile materials from extruded thermoplastic polymers, such as polypropylene, application of a spin oil to the filaments is standard practice. Spin finish including a spin oil is a lubricating composition deposited on the surface of the fiber to reduce the fiber-fiber friction and the friction developed as the yarn passes over the metal machinery surfaces. Spin oil typically contains a large number of chemical components, the major components being lubricant, antistatic agent and emulsifier. The amount of spin finish needed depends on the producer and manufacturing process, and typically the residual spin finish on the fiber varies between 0.7% and 5%. A major disadvantage of the use of a spin finish that includes a spin oil is that residues of the finish on the extruded fiber attract soil. It also decreases the efficiency of any protective treatment applied to the fiber and as such reduces the soil resistance of the finished products.

In the industrial production of textiles, such as carpet and apparel, it is common to treat such substrates with a composition to impart added desirable properties thereto, such as resistance to soiling by particulate or dry soil. Fluorochemical compositions are commercially used for this purpose. They can be applied to various substrates by methods which include, for example, spraying, foaming, padding, and finish bath immersion.

U.S. Pat. No. 4,264,484 discloses a liquid carpet treating composition containing a water-insoluble addition polymer that is derived from polymerizable ethylenically unsaturated monomer that is free of non-vinylic fluorine and has at least one major transition temperature higher than about 25° C., and a water-insoluble fluoroaliphatic radical- and aliphatic chlorine-containing ester having at least one major transition temperature higher than about 25° C.

U.S. Pat. No. 4,107,055 discloses a fabric coating composition, including a polymer having a glass transition temperature above room temperature, an ionic fluorinated surfactant and a carrier. The polymer is preferably applied to fabric at a rate giving a dry solids content of about 0.25 to 10%, to give dry soil resistance.

U.S. Pat. No. 4,043,964 discloses a coating which provides a durably soil-resistant carpet and which contains: (a) at least one phase of a specified, water-insoluble addition polymer derived from a polymerizable ethylenically unsaturated monomer that is free of non-vinylic fluorine, and (b) at least one phase of a specified, water-insoluble fluorinated component containing a fluoroaliphatic radical of at least 3 carbon atoms. The monomer from which the fluorinated component is formed may contain dicarboxylic acid, glycol, diamine, hydroxyamine, etc.

A common feature of the treating or coating compositions disclosed in the above-mentioned U.S. patents is that they are to be applied to the carpet or fabric after its production in a separate treating step. The application equipment and time required for such a treating step adds to the cost of the final product.

Textile fibers and yarns can also be treated by incorporation of a fluorochemical repellent treating agent in the spin finishing bath, for example, as disclosed in U.S. Pat. Nos. 4,190,545 and 4,192,754. A drawback of such a process is the formation of deposits on the rolls caused by sedimentation of the fluorochemical oil- and water-repellent agent/spin finish mixture. The deposit on the rolls can cause fiber breaks and must be removed frequently. This is time consuming and expensive and is no longer accepted as an application method by fiber manufacturers. Typically, the more spin finish added to the fluorochemical treating agent, the more roll build up occurs, and the greater the reduction in repellent properties of the finished product because of the high level of spin oil present on the treated substrate.

Alternatively, treated textile fibers and yarns can be obtained by melt extrusion of a blend of a synthetic fiber-forming polymer and a fluorochemical composition. Such melt extrusion is described for example in U.S. Pat. No. 3,839,312. This patent discloses that soil and stain repellency of extruded filaments of a synthetic resin can be improved by incorporating in the resin a small amount, about 1 percent, of an amphipathic compound having from one to four fluoroalkyl groups pendent from an organic radical. The repellency is provided by the fluoroalkyl groups, which tend to be concentrated at the surface of the fiber.

WO 92/18569 and WO 95/01396 disclose permanently soil resistant polymeric compositions such as fibers and yarns that have a fluorochemical dispersed throughout the polymer. These polymer compositions are prepared by melt extrusion of the fluorochemical with the desired polymer. Polymers that can be used with the fluorochemical include polyester, polypropylene, polyethylene and polyamide.

U.S. Pat. No. 5,025,052 discloses certain fluoroaliphatic group-containing oxazolidinone compositions. The patent also discloses fibers, films, and molded articles prepared, for example, by injection molding a blend or mixture of fiber-or film-forming synthetic organic polymers and certain fluorochemical oxazolidinones. The resulting fibers, films, and molded articles are said to have low surface energy, oil and water repellency, and anti-soiling properties.

European Pat. Pub. No. 0 516 271 discloses durably hydrophilic thermoplastic fibers comprising thermoplastic polymer and fluoroaliphatic group-containing non-ionic compounds.

While the above-mentioned publications, U.S. Pat. No. 3,839,312, WO 92/18569 and WO 95/01396, are successful in providing soil and stain repellency to a yarn or fiber and many currently used fluorochemical compositions have demonstrated utility in providing carpet with soil resistance, unfortunately a significant amount of the carpet or fabric manufactured cannot be treated to obtain the desired properties. The reason is that significant and varying amounts of spin oil often remain on the fiber or yarn, lowering the soiling resistance thereof or acting as contaminants which interfere with the fluorochemical treatment and diminish or prevent the desired result thereof.

WO 97/33019 discloses a carpet yarn that contains a hydrophilicity imparting compound dispersed in the filaments of thermoplastic polymer. Fluorochemical hydrophilicity imparting compounds are disclosed as preferred hydrophilicity imparting compounds. It is taught that as a result of the use of the hydrophilicity imparting compound in the filaments of the yarn, less or no spin oil is needed in the spin finishing bath and as a result, the carpet is less prone to soiling. Although this method is successful, the oil and/or water repellency properties of the obtained fibers is generally poor and there continues to be a desire to improve the soil repellency properties.

SUMMARY OF THE INVENTION

In one aspect, the invention provides a process for obtaining a fiber comprising the steps of:

melt extruding a mixture of thermoplastic polymer and hydrophilicity imparting compound to form a plurality of filaments;

applying a spin finish to said filaments;

and spinning said filaments into a fiber;

wherein said spin finish comprises fluorochemical. In preferred embodiments, the fluorochemical is an effective oil and/or water repellent and it imparts good oil and water repellency properties to the fiber.

One advantage of the invention is that roll build-up does not occur on the fibers made according to the process even though the application of spin finishes comprising fluorochemical to thermoplastic fibers typically results in roll build-up. Also, the resulting fibers generally show good oil and water repellency properties and soil resistance. Additionally, low levels of spin oil can be employed on fibers made according to the invention without sacrificing their antistatic properties.

In another aspect, the invention provides a fiber containing a plurality of filaments of a thermoplastic polymer having dispersed therein hydrophilicity imparting compound characterized in that the filaments comprise on at least part of their surface fluorochemical. As previously noted, the fluorochemical preferably is an effective oil and/or water repellent treatment and it imparts good oil and water repellency properties to the fiber. In yet another aspect, the invention provides a carpet or textile comprising such fibers.

DETAILED DESCRIPTION OF THE INVENTION

Thermoplastic polymers useful in the invention include fiber-forming poly(alpha)olefins, polyesters and polyamides. Preferred thermoplastic polymers are poly (alpha) olefins. Poly(alpha)olefins useful in the invention can include the normally solid, homo-, co- and terpolymers of aliphatic mono-1-olefins (alpha olefins) as they are generally recognized in the art. Usually, the monomers employed in making such poly(alpha)olefins contain 2 to about 10 carbon atoms per molecule, although higher molecular weight monomers sometimes are used as comonomers. Blends of the polymers and copolymers prepared mechanically or in situ may also be used. Examples of monomers that can be employed in the invention include ethylene, propylene, butene-1, pentene-1, 4-methyl-pentene-1, hexene-1, and octene-1, alone, or in admixture, or in sequential polymerization systems.

Examples of preferred thermoplastic poly(alpha)olefin polymers include polyethylene, polypropylene, propylene/ethylene copolymers, polybutylene and blends thereof Polypropylene is particularly preferred for use in the invention.

Processes for preparing the thermoplastic polymers useful in this invention are well known, and the invention is not limited to a polymer made with a particular catalyst or process.

Hydrophilicity imparting compounds useful in this invention may be fluoro-chemical or non-fluorochemical, mixtures of such compounds or mixtures of fluorochemical compounds and non-fluorochemical compounds. Non-fluorochemical hydrophilicity imparting compounds are substantially free of fluorine (preferably containing less than about 10% by weight and more preferably less than about 5% by weight of fluorine) and are generally hydrophilic in nature or contain at least a sufficient number of hydrophilic moieties such that hydrophilicity or wettability is provided to the surface of the thermoplastic polymer filaments. Included are low molecular weight compounds, oligomers and polymers. Suitable non-fluorochemical hydrophilicity imparting compounds are preferably incompatible with the thermoplastic polymer melt and are preferably stable at the required extrusion temperatures.

Suitable non-fluorochemical hydrophilicity imparting compounds can be anionic, cationic, non-ionic or amphoteric. Preferred compounds include compounds which are known to have utility as surfactants. Particularly preferred non-fluorochemical hydrophilicity imparting compounds are those that contain at least one poly(oxyalkylene) group.

Fluorochemical hydrophilicity imparting compounds useful in the invention are hydrophilic in nature and can include compounds, oligomers, and polymers. Such materials will contain at least about 10% by weight of fluorine (i.e., carbon-bonded fluorine). They contain one or more fluorochemical radicals ($R_f$), and one or more water solubilizing polar groups (Z), which radicals and groups are usually connected together by suitable linking groups (Q).

The fluorochemical radical, $R_f$, in the fluorochemical hydrophilicity imparting compound can be generally described as a fluorinated, preferably saturated, monovalent radical of at least about 4 carbon atoms. Preferably the fluorochemical radical is a fluoroaliphatic, non-aromatic radical. The aliphatic chain may be straight, branched, or, if sufficiently large, cyclic, and it may include oxygen, di- or hexavalent sulfur, or trivalent nitrogen atoms bonded only to carbon atoms. A fully fluorinated radical is preferred, but hydrogen or chlorine atoms may be present as substituents provided that no more than one atom of either is present for every two carbon atoms. Fluoroaliphatic radicals containing about 5 to about 12 carbon atoms are most preferred.

The water solubilizing polar group or moiety, Z, of fluorochemical hydrophilicity imparting compound can be a non-ionic, anionic, cationic, or amphoteric moiety, or combinations of said groups or moieties which may be the same or different. Preferably, the water solubilizing group comprises a poly(oxyalkylene) group, (OR')x, where R' is an alkylene group having 2 to about 4 carbon atoms, such as $—CH_2CH_2—$, $—CH_2CH_2CH_2—$, $—CH(CH_3)CH_2—$, and $—CH(CH_3)CH(CH_3)—$ or mixtures thereof, and x is an integer from about 6 to about 20. The oxyalkylene units in said poly(oxyalkylene) may be the same, as in poly (oxypropylene), or present as a mixture, such as in a heteric, straight or branched chain of randomly distributed oxyethylene and oxypropylene units (e.g., poly(oxyethylene-co-oxypropylene), or as in a straight or branched chain of blocks of oxyethylene units and blocks of oxypropylene units. The poly(oxyalkylene) chain can be interrupted by or include one or more catenary linkages, providing such linkages do not substantially alter the water-solubilizing character of the poly(oxyalkylene) chain. The Z group is terminated with hydroxyl or lower alkyl ether for example, $—OCH_3$ or $—OCH_2CH_3$. Typical anionic groups include $CO_2H$, $CO_2M$, $SO_3H$, $SO_3M$, $OSO_3H$, $OSO_3M$, $OPO(OH)_2$, and $OPO(OM)_2$, where M is a metallic ion (such as sodium or potassium), or ammonium ion, or other amine cation. Typical cationic groups include $NR_3^+A^-$, where R is a lower alkyl group such as methyl, ethyl, butyl, hydroxyethyl or hydrogen and A is an anion such as chloride, sulfate, phosphate, hydroxide or iodide. Typical mixed or amphoteric groups would include $N^+(CH_3)_2C_2H_4COO^-$, $N^+(CH_3)_2C_3H_6SO_3^-$ or an amine-oxide.

The linking group, Q, is a multivalent, generally divalent, linking group such as alkylene, arylene, sulfonamidoalkylene, carbonamidoalkylene, and other heteroatom-containing groups such as siloxane, including combinations of such groups. In some instances, more than one fluoroaliphatic radical may be attached to a single linking group. In other instances, a single fluoroaliphatic radical may be linked by a single linking group to more than one polar solubilizing group. Q can also be a covalent bond.

A particularly useful class of fluorochemical hydrophilicity imparting compounds are represented by the formula $$R_f—Q—Z$$

where $R_f$ is said fluoroaliphatic radical, Q is said linking group and Z is said water solubilizing group.

Hydrophilicity imparting fluorochemical non-ionic compounds useful in the present invention can be prepared using known methods such as those described in U.S. Pat. No. 2,915,554 (Albrecht et al.). The Albrecht patent discloses the preparation of fluoroaliphatic group-containing, non-ionic compounds from active hydrogen containing fluorochemical intermediates, such as fluoroaliphatic alcohols, e.g. $R_fC_2H_4OH$, acids e.g., $R_fSO_2N(R")CH_2COOH$, and sulfonamides, e.g., $R_fSO_2N(R")H$, by reaction of the intermediates with, for example, ethylene oxide to yield, respectively, $R_fC_2H_4O(C_2H_4O)_nH$, $R_fSO_2N(R")CH_2CO_2(C_2H_4O)_nH$, and $R_fSO_2N(R")(C_2H_4O)_nH$, where n is a number greater than about 3, and R" is hydrogen or lower alkyl (e.g., 1 to about 6 carbons). Analogous compounds can be prepared by treating the intermediates with propylene oxide or a mixture of ethylene oxide and propylene oxide. See also the fluoroaliphatic oligomers disclosed in U.S. Pat. No. 3,787,351 (Olson), and certain fluorinated alcohol-ethylene oxide condensates described in U.S. Pat. No. 2,723,999 (Cowen et al.).

The hydrophilicity imparting compound is typically added in amounts between about 0.05 and about 5% by weight, preferably between about 0.5 and about 1.5% by weight, based on the total weight of thermoplastic polymer.

Some examples of hydrophilicity imparting compounds include:

$C_8F_{17}SO_2N(C_2H_5)CH_2CH_2O(CH_2CH_2O)_7CH_3$

2 $C_8F_{17}SO_3H$

Jeffamine™ ED-600 di-salt (Jeffamine™ ED 600 is an amino terminated ethylene oxide-propylene oxide polymer)

copolymers of fluorochemical acrylates or methacrylates mono-acrylate or mono-methacrylates of polyethyleneoxide $C_8H_{17}SO_2N(C_2H_5)(CH_2CH_2O)_2—(CH(CH_3)CH_2O)_6H$ polyethylene oxide copolymers of ethylene oxide and propylene oxide ethoxylated alkyl phenols (such as Triton™ X-100, available from Union Carbide, Danbury, Conn.)

A fiber or yarn can be produced in accordance with the invention by providing a mixture comprising thermoplastic polymer and one or more hydrophilicity imparting compounds. This mixture can be extruded to form filaments which are then preferably cooled. The bundle of filaments is then typically treated in a spin finish bath. After receiving the spin finish treatment, the filaments are generally stretched. Stretching may be accomplished over a number of rolls that are at elevated temperature sufficient to soften the thermoplastic polymer. By rotating the rolls at different speeds, stretching of the filaments can be obtained. While stretching can be accomplished in one step, it may be desirable to stretch the filaments in two steps. Typically, the filaments will be stretched 3 to 4 times the extruded length. Subsequent to stretching, and in order to obtain a carpet yarn, it will often be desirable to texture the yarn with pressured air at an elevated temperature or steam jet and to subject it to an entanglement.

In accordance with the present invention, the spin finish comprises fluorochemical. Preferably, such fluorochemical is an effective oil and/or water repellent. Typically, the amount of fluorochemical in the spin finish will be between about 0.1% by weight and about 5% by weight, preferably between about 0.5% by weight and about 3% by weight. In general, the fluorochemicals useful in the invention include any of the known fluoroaliphatic radical-containing agents useful for the treatment of fabrics to obtain oil and water repellency. Fluorochemical radical-containing agents such as condensation polymers like polyesters, polyamides or polyepoxides, and vinyl polymers like polyacrylates, polymethacrylates or polyvinyl ethers are generally effective choices. Such known agents include, for example, those described in U.S. Pat. Nos. 3,546,187, 3,544,537, 3,470,124, 3,445,491, 3,341,497 and 3,420,697.

Further examples of useful fluoroaliphatic radical-containing water and oil repellency imparting agents include those formed by the reaction of perfluoroaliphatic glycols or thioglycols with diisocyanates to provide perfluoroaliphatic group-containing polyurethanes. These products are normally applied to fibers as aqueous dispersions. Such reaction products are described, for example, in U.S. Pat. No. 4,054,592. Another group of useful fluorochemicals are fluoroaliphatic radical-containing, N-methylol condensation products. These compounds are described in U.S. Pat. No. 4,477,498. Other examples of useful fluorochemicals include fluoroaliphatic radical containing polycarbodiimides which can be obtained, for example, by reaction of perfluoroaliphatic sulfonamido alkanols with polyisocyanates in the presence of suitable catalysts.

The fluorochemical can be a copolymer of one or more fluoroaliphatic radical-containing acrylate or methacrylate monomers, and one or more fluorine-free (or hydrocarbon) terminally ethylenically-unsaturated comonomers. Representative examples of such fluorochemical monomers include:

$CF_3(CF_2)_4CH_2OC(O)C(CH_3)=CH_2$ $CF_3(CF_2)_6(CH_2)_2OC(O)C(CH_3)=CH_2$ $CF_3(CF_2)_6(CH_2)_2OC(O)CH=CH_2$ $CF_3(CF_2)_7(CH_2)_2OC(O)CH=CH_2$ $$CF_3(CF_2)_7SO_2\overset{\overset{C_2H_5}{|}}{N}(CH_2)_2OC(O)CH=CH_2$$

$$CF_3CF_2(CF_2CF_2)_{2-8}CH_2CH_2OC(O)CH=CH_2$$

$$CF_3(CF_2)_7SO_2\overset{\overset{C_2H_5}{|}}{N}(CH_2)_2OC(O)C(CH_3)=CH_2$$

$$CF_3(CF_2)_7CH_2CH_2SO_2\underset{\underset{CH_3}{|}}{N}CH_2CH_2OC(O)C(CH_3)=CH_2$$

The preferred monomers to copolymerize with the above-described fluoroaliphatic radical-containing monomers include those selected from the group consisting of octadecylmethacryate, 1,4-butanediol diacrylate, laurylmethacrylate, butylacrylate, N-methylol acrylamide, isobutylmethacrylate, ethylhexyl acrylate, ethylhexyl methacrylate, vinylchloride and vinylidene chloride. The relative weight ratio of the fluoroaliphatic monomer(s) to the hydrocarbon co-monomer(s) can vary and is taught in the art.

Further examples of useful fluorochemicals include, for example, fluorinated group containing urethanes, ureas, esters, amines (and salts thereof), amides, acids (and salts thereof), carbodiimides, guanidines, allophanates, biurets, oxazolidinones, and other substances containing one or more fluorinated groups, as well as mixtures and blends thereof. Such agents are well known to those skilled in the art, see e.g., Kirk-Othmer, Encyclopedia of Chemical Technology, 3rd Ed., Vol. 24, pp. 448–451 and many (e.g., SCOTCHGARD® Fabric Protector, 3M) are commercially available as ready-made formulations.

In addition to the fluorochemical, the spin finish typically also includes any conventional spin oil used on extruded thermoplastic polymers. However, the spin finish may be aqueous without any spin oil. The spin finish can be applied using methods known in the art. One example includes kiss roll application. The lower part of the kiss roll dips in the finish bath, while the yarn tangentially moves over the top part. The add-on level of spin oil can be varied by changing several parameters, such as the geometry between yarn and roll, roll speed and the concentration of spin oil in the spin finishing bath. When spin oil is used, the parameters will be adjusted so that the residual amount of spin oil on the filament will be between about 0.01% and about 1.2% by weight, preferably between about 0.01% and about 0.6% by weight, based on the total weight of filaments and spin oil. Most preferably, the residual amount of spin oil will be less than about 0.4%.

The following examples further illustrate the invention without however the intention to limit the invention thereto.

EXAMPLES

All parts, percentages, etc. in the Examples and Comparative Examples are by weight unless otherwise noted.

Respective data of oil and water repellency and soil resistance shown in the Examples and Comparative Examples were based on the following methods of measurement:

Water repellency (WR) The water repellency of substrates was measured using a series of water-isopropyl alcohol test liquids. The water repellency of the substrates are expressed in terms of the "WR" rating. The WR rating corresponds to the most penetrating test liquid that did not penetrate or wet the substrate surface after 15 seconds exposure to the substrate. Substrates penetrated by or resistant to 100% water (0% isopropyl alcohol), the least penetrating test liquid, were given a rating of 0. Substrates resistant to 100% isopropyl alcohol (0% water), the most penetrating test liquid, were given a rating of 10. Other intermediate ratings were calculated by dividing the percent isopropyl alcohol in the test liquid by 10, e.g., a treated substrate resistant to a 70%/30% isopropyl alcohol/water blend, but not to an 80%/20% blend, would be given a rating of 7.

Oil repellency (OR) The oil repellency of substrates was measured using the AATCC procedure, standard test method No. 118-1983. The oil repellency of the substrates are expressed in terms of the "OR" rating.

Dry soil resistance: The dry soil resistance of substrates was measured using a method described in U.S. Pat. No. 5,370,919. A value of 5 indicates that there is no increase in soiling versus an unsoiled sample. A dry soil rating of 1 indicates that the substrate was severely soiled.

Determination of Fluorine in the Fiber

To determine the amount of fluorine in the extruded fiber described in the examples the following method was used. A known weight of the sample was placed in an ignition basket made from platinum wires. The sample was then decomposed in a sealed polycarbonate flask in the presence of oxygen and a known volume of buffer solution, TISAB III (available from Orion). After absorption in the buffer solution, the fluoride was measured with an Orion 9409 (fluoride sensitive) electrode connected to a pH meter using the mV-mode of operation. The amount of fluoride was calculated from the mV reading using a graph plotted using data collected from measurements on standard fluoride solutions. All samples were analyzed in duplicate and the results should show less than 10% variation to be considered uniform. When properly calibrated, the electrode measurement is reproducible with a deviation of about 2%.

Roll Build Up: Roll build up was measured by visually observing the amount of buildup on processing equipment during the production runs described in the examples. A scale of 0 to 5 was used to quantify the observed level of build up with 0 representing no visible build up and 5 representing severe build up. Values of 0 and 1 would represent very acceptable levels of roll build up.

Abbreviations

The following abbreviations and trade names are used in the examples:

PP polypropylene HG 235 J, a polypropylene with MFI 25, available from Borealis

Genapol™ UD 080 $C_{11}H_{23}(OCH_2CH_2)_{100}H$ (55% linear, 45% branched), available from B Alfonic™ 6–8.5 $C_6H_{13}(OCH_2CH_2)_{8.5}OH$, available from Condea-Vista, Austin PMA polymer melt additive

PMA-1 $C_8F_{17}SO_2N(C_2H_5)CH_2CH_2O(CH_2CH_2O)_7CH_3$

PMA-2 A 1:1 blend of Genapol™ UD 080 with MEFOSA/Alfonic™ 6-8.5 that was prepared according to the procedure for the synthesis of fluorochemical F-18, in U.S. Pat. No. 5,804,625, but using Alfonic™ 6-8.5 instead of Triton™ X-100

MEFOSA $C_8F_{17}SO_2N(CH_3)H$

PMA-3 Genapol™ UD 080

ETFOSE N-ethyl perfluorooctyl sulfonamido ethyl alcohol

PAPI Voronate M220, polyaromatic polymethylene polyisocyanate, available from Dow Chemical (Netherlands)

OWR Fluorochemical for use in spin finish.

OWR-1 A 50/50 blend of FC 398 and FC 399 Scotchgard™ Carpet Protectors, 24% solids, both commercially available from 3M.

OWR-2 Scotchgard™ Protector FC 248, 30% solids, commercially available from 3M.

OWR-3 Scotchgard™ Protector FC 3548, 30% solids, commercially available from 3M.

OWR-4 Scotchgard™ Protector FC 5102, 30% solids, commercially available from 3M. OWR-5 Scotchgard™ Protector FC 3860, 15% solids, commercially available from 3M.

OWR-6 Scotchgard™ Protector FC 3583, 20% solids, commercially available from 3M.

OWR-7 PAPI/ETHYLFOSE 1/3, prepared by heating PAPI and ETFOSE at 60° C. in ethylacetate, until completion of isocyanate reaction. The product was emulsified with Rew IM/OA (6% on solids) and Atpol E 5721 (2% on solids) at 20% solids.

OWR-8 Scotchgard™ Protector FC 1374, 20% solids, commercially available from 3M.

Rewopon IM/OA Imidazoline type surfactant, available from Rewo, Germany

Atpol E 5721 Alkylethoxylate, available from ICI, Wilton, UK.

SF Spin finish

FA 2820 Spin finish available from Zschimmer und Schwartz (Germany).

FA 2825 Spin finish available from Zschimmer und Schwartz (Germany).

Lurol™ NF-6239-20 Spin finish available from Devan NV (Belgium).

Lurol PP-3919 Spin finish available from Devan NV (Belgium).

rpm Revolutions per minute

Ex. Example

General Procedure for Producing Yarn

In a first step, masterbatches of polypropylene containing 25% (unless indicated otherwise) hydrophilicity imparting compound were prepared and extruded into granules. The granules were further blended with additional polypropylene to obtain an extrudable polypropylene composition comprising the desired level of hydrophilicity imparting compound. The so-formed blends were extruded with a Thermo Alfa single screw extruder (triply extruder-one end) at about 230° C. over spin plates with a trilobal cross section. After leaving the extruder, the filaments passed through a cooling zone over a kiss roll where an aqueous mixture of spin oil and fluorochemical (spin finishing bath) was applied. The amount of spin oil and fluorochemical applied to the yarn was varied by adjusting the kiss roll speed and the concentration of the compounds in the spin finishing bath. The carpet yarn was then drawn to about 3–4 times the extruded length to obtain a yarn with a tex (weight (g)/1000 m) of about 165. During the production of the yarn, there was little or no roll build up when a hydrophilicity imparting compound was added to the extrudable composition. Without the use of a hydrophilicity imparting compound, a sticky layer was deposited on the guidance rolls of the cooling unit which caused major problems and delays in the production of treated yarn. The yarn was textured at a temperature of about 140° C. to 180° C. to produce a bulked yarn that would be particularly useful for carpets. The bulked yarn was visually inspected for mechanical quality after spinning and texturing and bulked yarn made in accordance with the invention had no visible broken filaments. In order to create a substrate to test oil and water repellency and soil resistance, yarns were wrapped closely together around a piece of cardboard so there were no gaps between the yarns and a flat surface comprising one layer of yarn was obtained.

EXAMPLES 1 TO 3 AND COMPARATIVE EXAMPLES C-1

Examples 1 to 3 were made by using 0.4% PMA-1 as hydrophilicity imparting compound. The spin finishing bath contained different amounts of FA 2820 and OWR-1. Comparative Example C-1 was made without the use of PMA-1. In this case, it will be noted that a higher level of spin finish was needed in order to avoid too much static build up. Fiber composition and extrusion parameters of fibers are recorded in Table 1.

TABLE 1

Composition and Extrusion Parameters of Polypropylene Fibers

| Ex. | SF* (%) | OWR-1 (%) | Screw Speed (rpm) | Roll Build Up |
|---|---|---|---|---|
| 1 | 7 | 8 | 85 | 1 |
| 2 | 7 | 12 | 85 | 0 |
| 3 | 5 | 8 | 85 | 1 |
| C-1 | 10 | 8 | 52 | 5 |

*This value represents the percentage of spin finish used in the spin finishing bath, not the residual amount of spin finish on the fiber.

The data shows that samples prepared using PMA-1 had low or no roll build up despite the fact that a fairly low concentration of PMA-1 was used. During the run to produce Comparative Example C-1, severe roll build up occurred almost immediately, and the problem was more severe than would have been expected given the fact that only a slightly higher level of spin finish was used to make the C-1 fiber than was used to prepare the fibers of Examples 1 to 3.

The fibers were tested to determine their oil and water repellencies and dry soil resistance. The results are recorded in Table 2.

TABLE 2

Properties of Polypropylene Fibers

| Ex | OR | WR | Dry soil | F-Analysis (ppm) |
|---|---|---|---|---|
| 1 | 3 | 5 | 3 | 1652 |
| 2 | 3 | 3 | 3.5 | 2663 |
| 3 | 1 | 0 | 3.5 | 1878 |
| C-1 | 3 | 5 | 3 | 707 |

Although the repellent properties of C-1 were acceptable, there was such severe roll build-up during production that the process would be considered unacceptable for commercial manufacturing. Examples 1 and 2 had good dry soil values and acceptable oil and water repellencies. Example 3 had rather low oil and water repellency values but a good dry soil resistance.

EXAMPLES 4 TO 11 AND COMPARATIVE EXAMPLES C-2 TO C-6

Examples 4 to 11, PP containing 0.45% PMA-1 was extruded. Different spin finishes and amounts of OWR-1 were added to the spin finishing bath. Comparative Examples C-2 to C-6 were made with 0.45% PMA-1 in the melt, but without the use of any fluorochemical in the spin finishing bath. The amounts and types of spin finish and OWR-1 used, level of roll build up, oil and water repellencies and dry soil resistances, and fluorine content are given in Tables 3 and 4.

TABLE 3

Composition and Extrusion of Polypropylene Fibers

| Ex | Spin Finish (%) | OWR-1 (%) | Roll Build Up |
|---|---|---|---|
| 4 | 7% FA 2825 | 8 | 0 |
| 5 | 7% FA 2820 | 8 | 0 |
| 6 | 7% FA 2820 | 12 | 0 |
| 7 | 7% Lurol ™ NF-6239-20 | 12 | 0 |

TABLE 3-continued

Composition and Extrusion of Polypropylene Fibers

| Ex | Spin Finish (%) | OWR-1 (%) | Roll Build Up |
|---|---|---|---|
| 8 | 12% Lurol ™ NF-6239-20 | 12 | 0 |
| 9 | 20% Lurol ™ 6239-20 | 12 | 1 |
| 10** | 7% Lurol ™ PP-3919 | 12 | 0 |
| 11 | 7% Lurol ™ PP-3919 | 12 | 0 |
| C-2 | 7% FA 2825 | — | 0 |
| C-3 | 7% FA 2820 | — | 0 |
| C-4 | 7% Lurol ™ NF-6239-20 | — | 0 |
| C-5 | 20% Lurol ™ NF-6239-20 | — | 0 |
| C-6 | 7% Lurol ™ PP-3919 | — | 0 |

**This trial was run with a kiss roll speed of 18 rpm instead of the standard 13.5 rpm.

Yet the increased speed did not cause any major problems, indicating that processes conducted according to the invention are not as sensitive to an increase in spin finish add-on level as fiber spinning processes conducted without hydrophilicity imparting compound.

TABLE 4

Evaluation of Oil and Water Repellency and Dry Soil Resistance

| Ex | OW | WR | Soil Resistance | F-Analysis |
|---|---|---|---|---|
| 4 | 4 | 2 | 3.5 | 2243 |
| 5 | 3 | 4 | 2 | 2512 |
| 6 | 2 | 2 | 2.5 | 2910 |
| 7 | 3 | 7 | 3.5 | 2442 |
| 8 | 3 | 6 | 4 | 2258 |
| 9 | 3 | 7 | 3.5 | 2613 |
| 10 | 1 | 0 | 1.5 | 3122 |
| 11 | 2 | 1 | 2.5 | 2524 |
| C-2 | 0 | 0 | 3.5 | 1574 |
| C-3 | 0 | 0 | 3 | 1474 |
| C-4 | 0 | 0 | 3.5 | 1898 |
| C-5 | 0 | 0 | 4 | 1827 |
| C-6 | 0 | 0 | 2.5 | 1871 |

The data shows that fibers prepared with PMA-1 and OWR-1 in most instances possessed acceptable oil and water repellency properties and fairly good dry soil resistance properties, yet produced little or no roll build up.

EXAMPLES 12 TO 15 AND COMPARATIVE EXAMPLE C-7

Examples 12 to 15 were made using various amounts of PMA-1. The spin finishing bath contained different amounts of spin finish Lurol NF-6239-20 and 12% OWR-1. The composition and extrusion parameters for the examples are reported in Table 5 and the fiber properties are reported in Table 6. In Comparative Example C-7, no PMA was added.

TABLE 5

Composition and Extrusion Parameters of Polypropylene Fibers

| Ex. | SF* (%) | PMA (%) | Screw Speed (rpm) | Roll Build Up |
|---|---|---|---|---|
| 12 | 20 | 0.1 | 48 | 3 |
| 13 | 20 | 0.2 | 63 | 1 |
| 14 | 10 | 0.2 | 63 | 2 |
| 15 | 10 | 0.3 | 79 | 1 |
| C-7 | 20 | 0 | 50 | 5 |

*This value represents the percentage of spin finish used in the spin finishing bath, not the residual amount of spin finish on the fiber.

The data shows that the use of PMA-1 in the melt, even at very low concentrations, reduces roll build up.

TABLE 6

Properties of Polypropylene Fibers

| Ex | OR | WR | Dry Soil Resistance |
|---|---|---|---|
| 12 | 2 | 5 | 3.5 |
| 13 | 1 | 3 | 3 |
| 14 | 2 | 5 | 3 |
| 15 | 2 | 5 | 3 |
| C-7 | 1 | 6 | 3.5 |

Although some of the repellent properties of C-7 were good, severe roll build up rendered the process used to make the fiber unacceptable. Examples 12 to 15 possessed reasonably acceptable oil and water repellent properties and good dry soil resistance values.

EXAMPLES 16 TO 26 AND COMPARATIVE EXAMPLES C-8

In these examples, a more diluted PMA/PP master batch (3%) was used to prepare the fibers than was used in the other examples. The total amount of PMA-1 to prepare each Example is reported in Table 7. The spin finishing bath contained 8% OWR-1 and the type and amount of spin finish reported in Table 7. Comparative Example C-8 was made without the use of PMA-1. The compositions of the fibers are presented in Table 7 and the fiber properties are presented in Table 8.

TABLE 7

| Ex | Spin Finish | SF* (%) | PMA-1 (%) | Roll Build Up |
|---|---|---|---|---|
| 16 | Lurol NF 6239-20 | 20 | 0.13 | 1 |
| 17 | Lurol NF 6239-20 | 20 | 0.26 | 2 |
| 18 | Lurol NF 6239-20 | 15 | 0.26 | 0 |
| 19 | Lurol NF 6239-20 | 15 | 0.34 | 0 |
| 20 | Lurol NF 6239-20 | 15 | 0.45 | 0 |
| 21 | FA 2825 | 10 | 0.13 | 3 |
| 22 | FA 2825 | 10 | 0.26 | 4 |
| 23 | FA 2825 | 10 | 0.34 | 3 |
| 24 | FA 2820 | 10 | 0.34 | 3 |
| 25 | FA 2820 | 10 | 0.45 | 0 |
| 26 | FA 2820 | 7 | 0.45 | 1 |
| C-8 | Lurol NF 6239-20 | 20 | 0 | 5 |

*This value represents the percentage of spin finish used in the spin finishing bath, not the residual amount of spin finish on the fiber.

TABLE 8

Properties of Polypropylene Fibers

| Ex. | OR | WR | Dry Soil Resistance |
|---|---|---|---|
| 16 | 1 | 3 | 3 |
| 17 | 2 | 1 | 1 |
| 18 | 1 | 2 | 2.5 |
| 19 | 1 | 3 | 3 |
| 20 | 1 | 4 | 4 |
| 21 | 3 | 5 | 2 |
| 22 | 3 | 3 | 2 |
| 23 | 2 | 3 | 2 |
| 24 | 2 | 1 | 2 |
| 25 | 2 | 1 | 3 |
| 26 | 2 | 3 | 3.5 |
| C-8 | 1 | 3 | 3 |

The data shows that the process of the invention can be optimized to minimize roll build up by proper selection of spin finish, spin finish level and PMA concentration.

EXAMPLES 27 TO 34 AND COMPARATIVE EXAMPLE C-9

In Examples 27 to 34, PP fibers were extruded using 0.4% PMA-1. The spin finishing bath contained 15% Lurol NF 6239-20 and the various fluorochemicals listed in Table 9. Comparative Example C-9 was made without hydrophilicity imparting compound or fluorochemical. The composition of the fibers and roll build up values are set forth in Table 9 and the fiber properties are set forth in Table 10.

TABLE 9

Composition and Extrusion Parameters of Polypropylene Fibers

| Ex. | Fluorochemical | (%) | Fluorochemical Roll Build Up |
|---|---|---|---|
| 27 | OWR-1 | 8 | 2 |
| 28 | OWR-2 | 6.7 | 0 |
| 29 | OWR-3 | 6.7 | 0 |
| 30 | OWR-4 | 10 | 0 |
| 31*** | OWR-5 | 6.7 | 0 |
| 32*** | OWR-6 | 10 | 0 |
| 33 | OWR-7 | 10 | 1 |
| 34 | OWR-8 | 10 | 0 |
| C-9 | — | 0 | 0 |

***Slight static build up observed during production.

TABLE 10

Properties of Polypropylene Fibers

| Ex | OR | WR |
|---|---|---|
| 27 | 2 | 5 |
| 28 | 1 | 0 |
| 29 | 1 | 0 |
| 30 | 5 | 4 |
| 31 | 0 | 0 |
| 32 | 0 | 1 |
| 33 | 2 | 6 |
| 34 | 0 | 0 |
| C-9 | 0 | 0 |

The data shows that the oil and water repellency values achieved by each spin finishing bath composition is, to some extent, a function of the type of fluorochemical used to prepare the bath.

EXAMPLES 35 TO 38 AND COMPARATIVE EXAMPLE C-10

In Examples 35 to 38, PMA-2 was used as hydrophilicity imparting compound, at concentrations of either 0.4 or 0.8% as indicated in Table 11. The spin finishing bath contained 15% Lurol NF 6239-20 and the type and amount of fluorochemical given in Table 11. The fiber compositions and roll build up values are presented in Table 11 and the fiber properties are presented in Table 12.

TABLE 11

| Ex | Fluorochemical | Fluorochemical (%) | PMA (%) | Roll Build Up |
|---|---|---|---|---|
| 35 | OWR-1 | 8 | 0.4 | 3 |
| 36*** | OWR-1 | 8 | 0.8 | 0 |
| 37 | OWR-3 | 6.7 | 0.4 | 0 |
| 38 | OWR-3 | 6.7 | 0.8 | 0 |

***Some static build up observed during processing.

TABLE 12

Properties of Polypropylene Fibers

| Ex | OR | WR |
|---|---|---|
| 35 | 2 | 1 |
| 36 | 2 | 3 |
| 37 | 1 | 0 |
| 38 | 1 | 1 |

The data shows that roll build up and oil and water repellency can be optimized by proper selection of the type and amount of PMA and the type and amount of fluorochemical.

EXAMPLES 39 AND 40

Examples 39 and 40 were made using 0.4% PMA-3. The spin finishing bath contained 15% Lurol NF 6239-20 and the type and amounts of fluorochemical reported in Table 13. The fiber compositions and roll build up values are reported in Table 13 and the fiber properties are reported in Table 14.

TABLE 13

| Ex | Fluorochemical | Fluorochemical (%) | Roll Build Up |
|---|---|---|---|
| 39 | OWR-1 | 8 | 2 |
| 40 | OWR-3 | 6.7 | 0 |

TABLE 14

Properties of Polypropylene Fibers

| Ex. | OR | WR |
|---|---|---|
| 39 | 1 | 4 |
| 40 | 1 | 2 |

What is claimed is:

1. Process for obtaining a fiber comprising the steps of:

(a) melt extruding a mixture of a thermoplastic polymer and hydrophilicity imparting compound to form a plurality of filaments;

(b) applying a spin finish to said filaments; and (c) spinning said filaments into a fiber, wherein said spin finish comprises fluorochemical.

2. Process according to claim 1 wherein said hydrophilicity imparting compound comprises fluorochemical hydrophilicity imparting compound.

3. Process according to claim 1 wherein said hydrophilicity imparting compound consists of fluorochemical hydrophilicity imparting compound.

4. Process according to any of the previous claims wherein said hydrophilicity imparting compound is a nonionic compound.

5. Process according to claim 1 wherein said hydrophilicity imparting compound is represented by the formula:

$$R_f—Q—Z$$

wherein $R_f$ is a fluorinated, monovalent residue having at least about 4 carbon atoms, Q is a linking group or a covalent bond, and Z is a water solubilizing group.

6. Process according to claim 5 wherein Z comprises a poly(oxyalkylene) group.

7. Process according to claim 1 wherein the amount of hydrophilicity imparting compound in said mixture is between about 0.05% by weight and about 5% by weight relative to the weight of said thermoplastic polymer.

8. Process according to claim 1 wherein said thermoplastic polymer is a poly(alpha)olefin.

9. Process according to claim 8 wherein the poly(alpha) olefin is polypropylene.

10. Process according to any of the previous claims wherein said spin finish further comprises a spin oil.

* * * * *